United States Patent [19]

Okumura et al.

[11] Patent Number: 4,475,261

[45] Date of Patent: Oct. 9, 1984

[54] HAIRBRUSH

[75] Inventors: Takeo Okumura; Tsutomu Muraoka, both of Funabashi, Japan

[73] Assignee: Kao Corporation, Tokyo, Japan

[21] Appl. No.: 488,852

[22] Filed: Apr. 26, 1983

[30] Foreign Application Priority Data

May 10, 1982 [JP] Japan ..... 57-67705[U]

[51] Int. Cl.[3] ..... A46B 3/16

[52] U.S. Cl. ..... 15/195

[58] Field of Search ..... 15/159 R, 186, 191 R, 15/191 A, 195–205; 132/85

[56] References Cited

U.S. PATENT DOCUMENTS

| | | | |
|---|---|---|---|
| D. 253,321 | 11/1979 | Saute | 15/186 X |
| 1,957,363 | 5/1934 | Snell | 15/191 R |
| 2,289,313 | 7/1942 | Cave | 15/199 |
| 3,727,260 | 4/1973 | Spydevold | 15/186 UX |
| 4,030,158 | 6/1977 | Blair et al. | 15/186 |

FOREIGN PATENT DOCUMENTS

| | | | |
|---|---|---|---|
| 230777 | 10/1960 | Australia | 15/205 |
| 141856 | 9/1953 | Sweden | 15/199 |

*Primary Examiner*—Peter Feldman

*Attorney, Agent, or Firm*—Flynn, Thiel, Boutell & Tanis

[57] ABSTRACT

The invention relates to an improved hairbrush of the type in which a plurality of bristles are implanted into each bristle implantation hole formed on an implantation surface. Each implantation hole is divided into a plurality of compartments, bristles are implanted in pairs such that one or two bristles are implanted into each compartment, the gap between the bristles of each pair implanted into the separate but adjacent compartments is kept within the range of 0.4 to 1.2 mm, and the boundary lines between adjacent compartments are aligned geometrically.

15 Claims, 6 Drawing Figures

HAIRBRUSH

BACKGROUND OF THE INVENTION

This invention relates to a hairbrush. More particularly, the present invention relates to a hairbrush having a bristle implantation structure which prevents hairs from being caught by the bristles and yet provides a good brushing effect.

For the purpose of combing snarls out of hair to obtain a desired hairdo, a fundamental requirement is that the hairbrush should have a bristle implantation arrangement that does not apply any local force to the hair and does not catch or draw the hair, so that brushing can be accomplished while protecting the hair from damage. If any external localized force is applied to the hair, split ends or broken hairs may occur.

To prevent the application of such external localized force to the hair, prior art hairbrushes are known in which individual bristles are implanted in spaced-apart relationship. However, the bristles of such a hairbrush are not very stiff and do not provide a good brushing effect.

A large number of hairbrushes have also been proposed in which a plurality of bristles are implanted into each bristle implantation hole formed on the implantation surface. Although these brushes provide a good brushing effect, they are not free from the drawback that hairs are likely to become entangled in the bristles and thereby be damaged.

SUMMARY OF THE INVENTION

The inventors of the present invention have carried out intensive studies in search of a hairbrush which is less likely to damage the hair than known brushes, but which provides a good brushing effect, and have discovered that hair can be smoothly brushed without entanglement by implanting the bristles at specific relative positions, even if a plurality of bristles are implanted into each bristle implantation hole. The present invention has been completed on the basis of this discovery.

According to the present invention, in a hairbrush of the type in which a plurality of bristles are implanted into each of a plurality of bristle implantation holes formed in an implantation surface, the bristles implanted into each implantation hole comprise at least one pair of bristles or a plurality of pairs of bristles. The spacing or gap between the two bristles of each pair is within a particular range, and the gaps extend in predetermined directions. A hairbrush in which the bristles do not catch hairs during brushing, and which provides an excellent brushing effect, is thereby provided.

The present invention can be implemented by integrally molding the bristles and the bristle implantation region in such a fashion that the relative positions of the bristles satisfy the predetermined requirements described below. From the viewpoints of workability during molding, etc., a more preferable method is to form bristle implantation holes in the implantation surface and implant the bristles into the holes to produce the hairbrush. Hence, the present invention will be described in detail with reference to a hairbrush produced by the method of implanting bristles into bristle implantation holes.

As described above, the present invention relates to a hairbrush of the type in which a plurality of bristles are implanted into each bristle implantation hole. Each implantation hole is divided into a plurality of separate compartments, preferably two such compartments. The bristles are implanted in pairs so that at least one bristle is implanted into each compartment, and the bristles of each pair are disposed in different compartments. The separation or gap between bristles of each pair implanted into adjacent compartments is kept within a predetermined range, and the imaginary boundary lines dividing adjacent compartments in each bristle implantation hole are arranged in a geometrical pattern and extend in predetermined directions. The desired effects of the invention are obtained by this arrangement.

Hereinafter, a preferred embodiment of the present invention will be described with reference to the accompanying drawings. It is to be noted, however, that this embodiment is merely illustrative and is not limitative of the invention.

DESCRIPTION OF THE PREFERRED EMBODIMENTS

Figure 6:
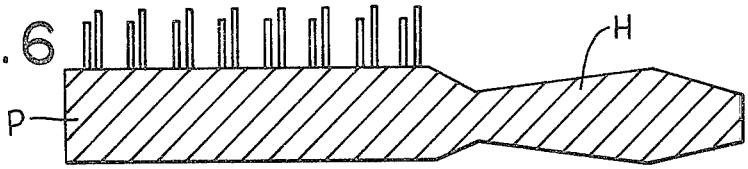
FIG. 6 is a schematic sectional view of a hairbrush embodying the bristle arrangement according to the invention.

The hairbrush shown in FIG. 6 is comprised of a handle H and a bristle-implanted body portion P extending longitudinally from the handle. The bristle-implanted body portion P has a plurality of groups of bristles implanted therein as described below.

Figure 1:
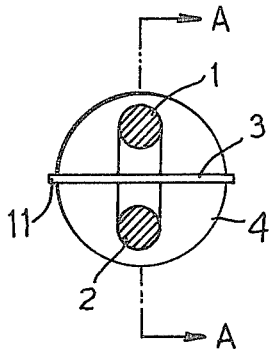
FIG. 1 is a top view of a bristle implantation hole of the hairbrush of the present invention, and shows the bristles in cross-section.
Figure 2:
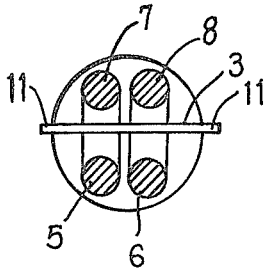
FIG. 2 is a top view of a modified bristle implantation hole containing two pairs of bristles which are shown in cross-section.

FIGS. 1 and 2 are views showing a bristle implantation hole 4 when viewed from above. This implantation hole 4 is divided into two compartments by a flat plate 3 which defines a central boundary line between the two compartments. FIG. 1 shows the case in which a single bristle 1 or 2 is implanted into each compartment of the bristle implantation hole 4. FIG. 2 shows the case in which two bristles 5, 6 and two bristles 7, 8 are implanted into each compartment.

Figure 3:
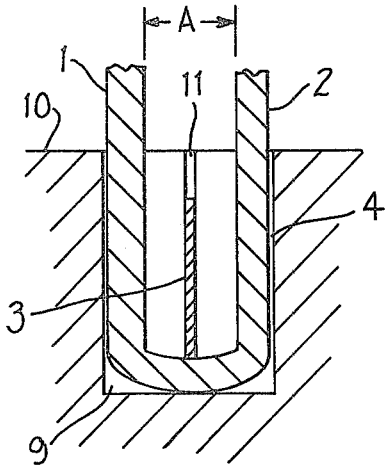
FIG. 3 is a sectional view of the bristle implantation hole of FIG. 1 taken along the line A—A of FIG. 1.

FIG. 3 is a sectional view of the bristle implantation hole 4 shown in FIG. 1, cut through the center of the bristle implantation hole 4 in the direction perpendicular to the flat plate 3.

In the present invention, at least two bristles are implanted into each bristle implantation hole 4. Preferably, 2, 4 or 6 bristles are implanted into each hole 4. When four bristles are implanted into each hole, it is preferred that two bristles be implanted into each compartment as shown in FIG. 2. The bristles are implanted in the following manner. As shown in FIG. 3, an elongated strand is bent near its center into substantially U shape. After the strand is implanted into the bristle implantation hole 4, it is fixed to the bottom 9 of the hole 4 by the flat plate 3 to prevent it from coming out of the hole. In this manner, the single strand is shaped to define two outwardly extending, parallel legs, thereby providing the two bristles 1 and 2 which are implanted each into one of the compartments of the hole and are located on opposite sides of the plate 3. Similarly, the pairs of bristles 5, 7 and 6, 8 shown in FIG. 2 are each implanted by bending single elongated strands and fixing them in place with the flat plate 3, in the same manner as for the bristles 1 and 2 shown in FIG. 3.

The flat plate 3 that fixes the bristles inside the bristle implantation hole is substantially longer than the diameter of the bristle implantation hole 4, and the opposite edges thereof are inserted into grooves 11 provided in the bristle implantation bed 10 at diametrically opposite locations on each bristle implantation hole 4. A hairbrush constructed in this manner is preferred because the bristles do not fall out. The wall thickness of the flat plate 3 is less than the width of the gap A between the bristles 1, 2. The wall thickness of the plate 3 is not particularly critical, but from the viewpoints of the fixing effect and ease of production, this thickness should be between 0.1 to 0.8 mm and, preferably, between 0.2 to 0.4 mm.

The number of flat plates 3 disposed inside a bristle implantation hole 4 is preferably one per hole. In other words, the number of compartments in each bristle implantation hole is most suitably two. If two or more bristles are implanted in one compartment, it is preferred that each of the bristles in the same compartment be implanted in a row lying on a line parallel to the line that divides the hole 4 into compartments, that is, parallel to the flat plate 3.

Figure 4:
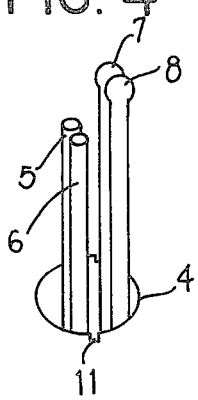
FIG. 4 is a perspective view of the bristles implanted into the bristle implantation hole of FIG. 2.

The diameter of the bristles 1, 2 or 5, 6, 7 and 8, implanted into the bristle implantation holes should be between 0.4 to 1.0 mm, preferably 0.4 to 0.6 mm. The distance that the end portions of the bristles protrude above the upper surface of the bristle implantation bed 10 is not particularly critical, but should preferably be from 17 to 27 mm. The bristles of each pair, such as 1 and 2, can protrude the same or different lengths. As illustrated in FIG. 4, one bristle of each pair, such as bristles 7 and 8, is preferably longer by 2 to 8 mm, particularly by 3 to 6 mm, than the other bristle of each pair such as shorter bristles 5, 6. Enlarged spherical molded tips having a diameter of from 1.2 to 2.5 times the diameter of the bristle are preferably formed at the upper ends of the longer bristles 7, 8.

It is necessary in the present invention that the spacing or gap A between the closest points on the bristles of a pair of bristles implanted in adjacent compartments, for example the spacing between the opposing surfaces of bristles 1 and 2, be in the range of 0.4 to 1.2 mm, preferably in the range of 0.4 to 0.8 mm. If this distance is less than 0.4 mm, the bristles 1 and 2 (or 5, 6 and 7, 8) are so close to each other, especially at the locations where they enter the hole 4, that hairs are likely to become caught between them. If this distance is more than 1.2 mm, on the other hand, the stiffness of the bristles is so greatly reduced that the brushing effect is diminished.

There is no particular limitation on the diameter of the implantation holes 4 so long as the separation between opposing bristles of each pair implanted into the different compartments of an implantation hole satisfies the above requirement. In order to prevent the implanted bristles 1, 2 from falling out and to ensure a sufficient stiffness of the bristles 1, 2, however, the diameter of the implantation holes 4 should be in the range of 1.6 to 3.0 mm, preferably in the range of 1.8 to 2.4 mm.

Figure 5:
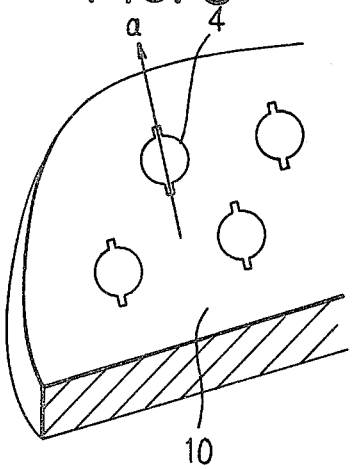
FIG. 5 is a partial perspective view showing a series of bristle implantation holes arranged on an implantation bed of the hairbrush.

In the hairbrush of the present invention, it is further necessary that each flat plate 3 that divides each bristle implantation hole 4 into two compartments is arranged to extend in a predetermined direction in each hole. As shown by the arrangement of the bristle implantation holes 4 depicted in FIG. 5, for example, the boundary lines a must be geometrically arranged so as to extend in the same predetermined direction, which direction is transverse to the longitudinal axis of the hairbrush. In the context of this invention, the term "predetermined direction" not only includes an arrangement in which the lines a extend linearly in one direction, e.g. perpendicular to the longitudinal axis of the hairbrush, but also includes an arrangement in which a plurality of the bristle implantation holes 4 are arranged along one or more substantially concentric curves, and the boundary lines a of those holes are arranged in predetermined directions that substantially conform with or lie on the curves. The bristle implantation holes are thus arranged to form a regular, repeating pattern which is rectilinear or curvilinear. In accordance with the present invention, therefore, the dimension of the gap A between opposing bristles of each pair implanted into different adjacent compartments of each bristle implantation hole 4 is kept within a predetermined range and all the gaps are arranged to extend in a predetermined direction corresponding to the direction in which the bristles are pulled through the hair. The foregoing gaps are preferably perpendicular to the corresponding boundary line or lines for each implantation hole.

According to this arrangement, hairs are not caught by the bristles when they are being brushed, and a hairbrush having an excellent brushing effect can be obtained. It is preferable that the direction of alignment of the gaps between opposing bristles in different compartments of an implantation hole be substantially at right angles to the hairbrush handle H which extends from one end of the bristle implantation bed 10. In other words, it is preferable that the flat plates 3 inside each bristle implantation hole 4 are positioned at right angles to the hairbrush handle. Thus, when the hairbrush is moved across the head in a direction substantially perpendicular to the lengthwise extent of the hairbrush, the hairs will be contacted by the bristles and they will be free to move through the gaps between the pairs of bristles.

In order to obtain a sufficient brushing effect, the implantation density of the bristles of the hairbrush of the present invention should be in the range of 8 to 30 bristles/$cm^2$, preferably 10 to 18 bristles/$cm^2$. Although nylon is suitable as the material of which the bristles are made, various other synthetic resins such as polypropylene, polybutylene terephthalate and the like can also be used. These synthetic resins can be subjected to various treatments such as an anti-static treatment, a surface treatment, a pigmentation treatment, and the like.

What is claimed is:

1. A hairbrush including a handle, a brush head extending from said handle, said brush head having a bristle implantation surface having a plurality of spaced-apart bristle implantation cavities formed therein, and a plurality of bristles implanted in said bristle implantation cavities, wherein the improvement comprises:

a plurality of U-shaped elongated filaments, each of said filaments comprising a pair of parallel, upwardly extending legs which form a pair of said bristles and a bottom web which connects said parallel legs, said web and the adjacent portions of said legs being disposed in the associated bristle implantation cavity with the web being located adjacent to the bottom of the cavity, at least one of said filaments being disposed in each of said bristle implantation cavities; and a plate set in and fixed into each of said bristle implantation cavities, said plate dividing the bristle implantation cavity into a pair of compartments, the bottom edge of said plate being in contact with the web or webs of said U-shaped filaments set in the bristle implantation cavity and securing the filament associated therewith against the bottom of the bristle implantation cavity, whereby the bristles of each pair extend from adjacent compartments of the same bristle implantation cavity, the two bristles of each of said pairs being spaced apart in a direction perpendicular to the associated plate disposed between said two bristles by a distance in the range of from 0.4 to 1.2 mm, each of said plates defines an imaginary boundary line for two adjacent compartments of each of said implantation cavities, all of said boundary lines being arranged in a regular geometrical pattern adapted to minimize hair entanglement on said bristles and maximize brushing effectiveness when said hairbrush is used to brush hair.

2. A hairbrush as claimed in claim 1, wherein each of said bristle implantation cavities contains at least two of said pairs of bristles, at least two bristles are located in the two compartments of each bristle implantation cavity, the bristles within each compartment are aligned in a row, and the rows of said bristles within each bristle implantation cavity are parallel to each other.

3. A hairbrush as claimed in claim 1, wherein a pair of opposed grooves is formed in the opposing sides of each of said bristle implantation cavities, the edge portions of each of said plates being inserted into said grooves of the associated cavity.

4. A hairbrush as claimed in claim 1, wherein each of said bristle implantation cavities is divided into two compartments by one of said plates, each of said U-shaped filaments is formed with one enlarged rounded end, two of said U-shaped filaments are disposed in each of said bristle implantation cavities so that two bristles extend from each of said two compartments of each bristle implantation cavity, and each of said U-shaped filaments is positioned so that the upwardly extending legs thereof which form bristles having enlarged, rounded ends thereon are in the same compartment and extend farther out of the associated bristle implantation hole than the legs comprising bristles in the other of said two compartments of the associated bristle implantation cavity.

5. A hairbrush as claimed in claim 1, wherein each of said bristle implantation cavities has one of said U-shaped elongated filaments set therein.

6. A hairbrush as claimed in claim 1, wherein each of said bristle implantation cavities has two of said U-shaped elongated filaments set therein.

7. A hairbrush as claimed in claim 1, wherein said plates each have a thickness in the range of 0.1 to 0.8 mm, each of said U-shaped, elongated filaments has a thickness in the range of 0.4 to 1.0 mm, and each of said bristles which protrudes out of the associated bristle implantation hole a distance in the range of from 17 to 27 mm.

8. A hairbrush as claimed in claim 4, wherein said longer legs having said enlarged, rounded ends are 2 to 8 mm longer than said legs in the other of said compartments of the associated bristle implantation cavity.

9. A hairbrush as claimed in claim 1, wherein said distance between the bristles of each of said pairs is in the range of 0.4 to 0.8 mm.

10. A hairbrush as claimed in claim 1, wherein said bristle implantation cavities are essentially cylindrical in shape and have diameters in the range of from 1.6 to 3.0 mm.

11. A hairbrush as claimed in claim 1, wherein the implantation density of said bristles relative to said implantation surface is in the range of 8 to 30 bristles/$cm^2$.

12. A hairbrush as claimed in claim 2, wherein said boundary lines are arranged such that all of said boundary lines are parallel to each other, and all of said rows are parallel to said boundary lines.

13. A hairbrush as claimed in claim 1, wherein said bristle implantation cavities are arranged in a plurality of parallel, linear rows, each of said rows comprising a plurality of said bristle implantation cavities, and said boundary lines are all parallel to each other and perpendicular to the longitudinal axis of the hairbrush.

14. A hairbrush as claimed in claim 1, wherein said regular geometric pattern is a rectilinear pattern formed by a plurality of spaced-apart rows of said bristle implantation cavities.

15. A hairbrush as claimed in claim 1, wherein said regular geometric pattern is a curvilinear pattern formed by a plurality of spaced-apart, curved rows of said bristle implantation cavities.

* * * * *